United States Patent [19]

Traylor

[11] Patent Number: 4,572,438

[45] Date of Patent: Feb. 25, 1986

[54] AIRLESS SPRAY GUN HAVING IMPROVED NOZZLE ASSEMBLY AND ELECTRODE CIRCUIT CONNECTIONS

[75] Inventor: John C. A. Traylor, Elyria, Ohio

[73] Assignee: Nordson Corporation, Amherst, Ohio

[21] Appl. No.: 609,764

[22] Filed: May 14, 1984

[51] Int. Cl.[4] ..... B05B 5/02

[52] U.S. Cl. ..... 239/708; 239/690; 239/600

[58] Field of Search ..... 239/690–708, 239/3, 600; 118/621, 627, 629, 624, 626

[56] References Cited

U.S. PATENT DOCUMENTS

| | | | |
|---|---|---|---|
| 2,710,773 | 6/1955 | Sedlacsik | 239/707 |
| 3,292,860 | 12/1966 | Williams et al. | 239/705 |
| 3,677,470 | 7/1972 | Probst et al. | 239/707 |
| 3,731,145 | 5/1973 | Senay | 239/708 X |
| 3,764,068 | 10/1973 | Lacchia | 239/707 X |
| 3,938,740 | 2/1976 | Bertilsson et al. | 239/707 |
| 4,066,041 | 1/1978 | Buschor et al. | 239/708 X |
| 4,182,490 | 1/1980 | Kennon | 239/691 X |
| 4,228,961 | 10/1980 | Itoh | 239/698 |
| 4,258,655 | 3/1981 | Bagby et al. | 239/707 X |
| 4,324,361 | 4/1982 | Moos et al. | 239/706 X |
| 4,355,764 | 10/1982 | Rood et al. | 239/708 |

FOREIGN PATENT DOCUMENTS

| | | | |
|---|---|---|---|
| 2048639 | 4/1972 | Fed. Rep. of Germany | 239/691 X |

*Primary Examiner*—Jeffrey V. Nase
*Assistant Examiner*—James R. Moon, Jr.
*Attorney, Agent, or Firm*—Wood, Herron & Evans

[57] ABSTRACT

A spray gun for airless atomization for electrostatic deposition of a coating material upon a substrate includes a novel dual electrode element having a spring loop portion. The two electrodes are the respective end portions of a single electrode wire, which has its major portion between the electrodes formed into a spiral spring. A tip resistor is provided with a conductive fitting that presents a broad and sturdy bearing surface which abuts the electrode spring portion to thereby directly connect the electrode with a high voltage charging circuit. The electrode spring accommodates spacing variations between the electrode and tip resistor, and provides a continuous electrical connection regardless of the rotational position of the electrode relative to the tip resistor. The dual electrode spring further serves to secure a number of otherwise loose parts of the gun nozzle assembly together, and prevents the parts from falling out and getting lost when the nozzle assembly is removed from the spray gun. An improved electrical circuit is also achieved through the use of a conductive cap which surrounds one end of a high voltage barrel resistor used in the gun. The conductive cap has a portion which extends along the barrel resistor body which is electrically connected to the tip resistor by a spring lead from the tip resistor.

19 Claims, 7 Drawing Figures

POWER SUPPLY
LIQUID SOURCE

AIRLESS SPRAY GUN HAVING IMPROVED NOZZLE ASSEMBLY AND ELECTRODE CIRCUIT CONNECTIONS

FIELD OF THE INVENTION

This invention relates to apparatus for airless atomization for electrostatic deposition of a coating material upon a substrate.

BACKGROUND OF THE INVENTION

Commercial equipment for atomizing and electrostatically depositing coating material, such as paint, commonly utilizes either airless or air atomization of the coating material. In coating certain types of articles, as where a high coating delivery rate is desired, or where there is a need to penetrate into a recess, for example, it is desirable to atomize the coating material without the presence of air. This is done by projecting the coating material through a small nozzle orifice under high pressure. The interaction of the pressurized stream of coating material with air as it passes through the small nozzle orifice causes a break-up, or atomization, of the coating material into small particles, which then may be electrostatically charged.

The electrostatic charge has the effect of improving the efficiency of deposition of the coating material onto the substrate being coated. An electrode, also sometimes called an antenna, is commonly located near the spray nozzle, and is connected to a source of high voltage to establish an electrostatic field in the vicinity of the region of atomization. The electrostatic field imparts a charge to the spray particles which causes the particles to be attracted to a grounded substrate. The charged atomized coating material is in effect drawn to the substrate, resulting in increased and more efficient deposition of coating material.

An airless spray gun and spray gun system such as that described is disclosed in U.S. Pat. No. 4,355,764. Spray guns of this type are characterized by an elongated electrode for charging the atomized spray from the gun nozzle. The electrode of such guns is characteristically connected to a high voltage power supply through electrical circuitry contained in the the spray gun body. Such circuitry includes a high ohmage resistor in the gun barrel to reduce the current flow to the electrode and to avoid inadvertent discharge of electricity or arcing if the gun is moved too close to a grounded workpiece or too close to a grounded wall of the spray booth within which the gun is operating.

In order to further reduce the current to the electrode and the capacity of the gun, such guns also characteristically include a "tip" resistor in the electrical circuit between the barrel resistor and the electrode. A typical tip resistor has a bent thin wire lead extending from its forward end to electrically connect the tip resistor to the electrode. Generally this electrical connection includes a conductive washer positioned so that the base of the electrode contacts one face of the washer and the bent wire lead the other face. The bent lead end gives the connection some resiliency to accommodate spacing differences between the electrode and tip resistor due to tolerance variations in the nozzle assembly parts. The rearward end of the tip resistor characteristically has another thin wire lead which connects the tip resistor to the barrel resistor.

It has been found that when the nozzle assembly is removed and then replaced in electrostatic spray guns of the type described hereinabove, such as for changing nozzles or for cleaning of the nozzle assembly, the lead at the front of the tip resistor is bent and flexed. Repeated bending and flexing can result in the lead snapping, thereby breaking contact between the tip resistor and the electrode, and interrupting power to the electrode. The tip resistor then has to be removed from its bore and replaced with a new tip resistor having a good lead.

Replacement of the tip resistor in this type of gun has been complicated by the fact that the rearward lead of the tip resistor has to be connected to the barrel resistor. The rearward lead has to be inserted in the front of the bore in which the barrel resistor is received where it can contact the conductive end of the barrel resistor. In order to ensure good electrical contact however, the barrel resistor has to be removed for proper positioning of the tip resistor lead, with the barrel resistor than replaced in position. This procedure entails further disassembly of the gun in order to access the barrel resistor. A good solid electrical connection between the elements making up the electrical circuitry, and between those elements and the electrode, is of course of critical importance in the operation of the spray gun.

The nozzle assemblies of spray guns of the type described typically have a number of small internal parts. Some of these parts are loose when the assembly is not attached to the gun.

As is often the case when cleaning the nozzle assembly, it will be taken off of the gun over a vat of cleaning solvent. The loose parts can easily fall out of the nozzle assembly and into the solvent vat, where they can be difficult to locate and retrieve. The loose parts can likewise be dropped and become lost when the nozzle assembly is being changed. Replacement of the lost parts is of course costly, and consumes time when the spray gun could otherwise be productively used.

SUMMARY OF THE INVENTION

One objective of this invention is to provide a better and more dependable tip resistor to electrode connection which is not affected by repeated nozzle assembly adjustments. It is in accordance with this invention to further provide a direct tip resistor to electrode connection in a manner which readily accommodates spacing variations which may exist between the tip resistor and electrode elements, such as may be caused by tolerance differences in the nozzle assembly parts, and which ensures continuous electrical contact for charging the electrode.

Yet another object of the invention is to provide a tip resistor which can be easily replaced without requiring manipulation of the barrel resistor to electrically connect the tip resistor thereto, and to provide an assured electrical connection between the barrel resistor and the tip resistor simply from insertion of the tip resistor in its bore. Still a further object is to better seal the bores within which the tip resistor and barrel resistor are located against solvent leaking therein.

It is another objective of the invention to provide a mechanism to associate the loose pieces making up the nozzle assembly to prevent them from becoming lost when the nozzle assembly is removed from the spray gun.

These objectives, as well as others, have been accomplished by this invention in an improved airless spray gun which includes a novel electrode element having a spring loop portion. The preferred electrode element has two electrodes, one long and one short, which both extend through throughbores in the nozzle assembly. The electrodes are the respective end portions of a single electrode wire which has its major portion between the electrodes formed into a spiral spring. The two electrodes form the forward portions of the electrode element, with the spring forming the rearward portion and having a forward loop and a rearward loop.

A direct electrical connection between the tip resistor and the electrode is made in this invention through the use of a conductive fitting fixed to the forward lead of the tip resistor which presents a relatively broad and sturdy bearing surface that abuts against the rearward loop of the electrode spring. A number of significant advantages are immediately realized by this arrangement. First, a circuit part in the form of the conductive washer formerly used is eliminated, being replaced by the electrode spring. Second, good direct electrical contact between the tip resistor and the electrode is assured, since the electrode spring portion is resilient and therefore accommodates differences in the distance between the tip resistor bearing surface and the electrode, such as may be caused by tolerance variations between the nozzle parts. Continuous electrical contact is likewise maintained by the circular shaped rear spiral loop which always engages the tip resistor bearing surface regardless of the rotational position of the nozzle assembly relative to the tip resistor. Thirdly, the flimsy bent electrical lead contact formerly commonly used with the tip resistor is eliminated, being replaced by a sturdy and broad bearing surface. The broad bearing surface is of course not subject to breakage problems from the nozzle assembly being repeatedly removed from and reattached to the gun.

Another significant advantage of this invention is also accomplished through the use of the electrode spring. As noted, the nozzle assembly has small parts, two of which are a nozzle adapter within which the nozzle is mounted and which is itself mounted within a nozzle support ring, and a sealing plug which connects the nozzle mount with a liquid passage in the gun body so that liquid will flow from the passage through the plug and adapter and then to the nozzle. The forward loop of the electrode spring portion is received in a recess on the sealing plug and holds the sealing plug within the loop. The two electrodes are carried by the nozzle support ring, and the sealing plug is consequently held in place within the nozzle assembly. The sealing plug in turn holds the nozzle adapter in place within the support ring, since the forward end of the sealing plug seats in the adapter mount. There is thus no longer any problem of losing these nozzle assembly pieces when the nozzle assembly is removed from the spray gun. Further, the two electrodes are simply pulled out of their channels to disassociate the nozzle assembly parts, when desired.

Another aspect of this invention is in an improved electrical connection between the tip resistor and the barrel resistor. To this end, the tip resistor is provided with a spring lead at its rearward end which engages a conductive cap surrounding the forward end of the barrel resistor. The conductive cap extends for a small distance rearwardly of the forward portion of the barrel resistor, thus enabling an electrical connection with the barrel resistor rearwardly of the front end. That is, the rearward lead from the tip resistor no longer has to engage the front of the barrel resistor for electrical contact, but rather need only make electrical contact with a rearward portion of the conductive cap. Replacement of the tip resistor thus no longer requires that the barrel resistor be disturbed, since the rearward lead from the tip resistor need now merely engage the conductive cap to make electrical connection. The use of a spring lead further assures that a good electrical connection between the cap and the tip resistor will be made. Replacement of the tip resistor, when necessary, is thus readily accomplished by withdrawing the tip resistor needing replacement from its bore, and simply sliding a new unit into place.

Both the fitting for the tip resistor and the conductive cap for the barrel resistor are also provided with O-ring seals which are concentric with the resistors and which serve to seal their respective resistor bores against solvent or other liquid leaking therein. Extra protection against damage to the resistor from leaking solvent is thus provided by this invention.

These and other objects and advantages of this invention will be made more readily apparent from the following detailed description of the invention taken in conjunction with the following drawings, in which:

DETAILED DESCRIPTION OF THE INVENTION

Figures 1, 2, 4:
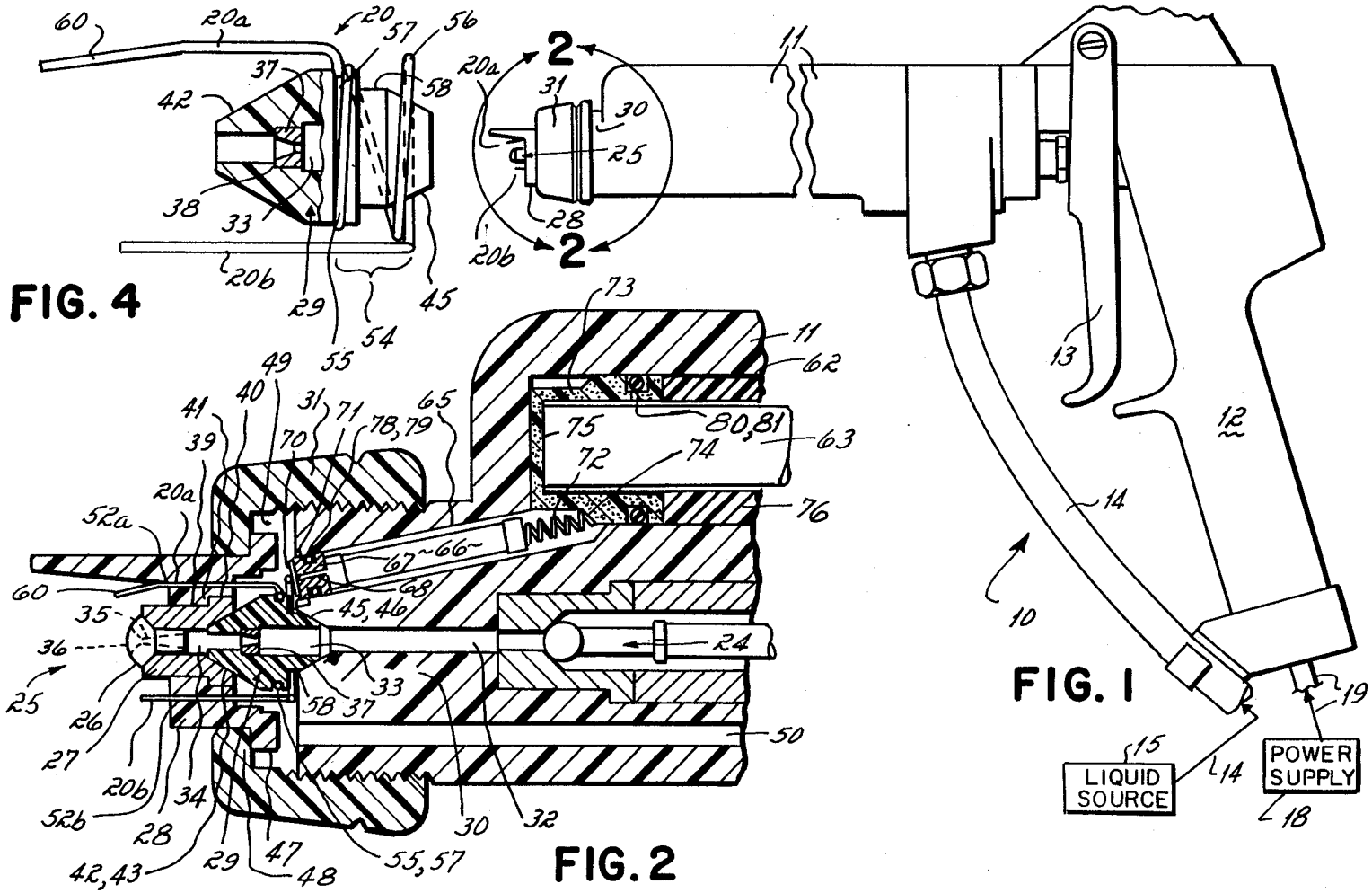
FIG. 1 is a partially diagrammatic illustration of an electrostatic airless spray system incorporating the invention.
FIG. 2 is an enlarged cross-sectional view of the forward portion of the spray gun within the circled area 2—2 of FIG. 1.
FIG. 4 is an enlarged view of the dual electrode spring and sealing plug as assembled.

FIG. 1 illustrates an airless spray system which includes the invention of this application. The system includes a gun 10 which would ordinarily be held in the hand of an operator. The gun need not be handheld, however, but may be mounted on a robot, platform, etc., and either fixed or movable. In use, articles (not shown), are conveyed past the nozzle of the gun 10 to be coated or sprayed.

The gun 10 has a body portion 11, a handle 12, and a trigger 13. A hose 14 connects the gun with a source 15 of coating material under high pressure, typically on the order of 300 to 1000 p.s.i. An exemplary coating material would be an enamel paint to be applied to automobile framework, furniture, etc. It will be noted that most of the coating materials sprayed will contain a solvent, which can be highly corrosive to the resistive elements in the spray gun circuitry. Solvents are also used for cleaning purposes, such as in a changeover from one color paint to another.

An electrical power supply 18 is connected to the gun 10 through a cable 19. Power carried by the cable 19 passes through electrical circuitry, to be described in more detail hereafter, to an electrode element 20, which generates an electrostatic field to charge particles atomized through passage through a nozzle insert 26. The electrode element 20 has a dual electrode, i.e. it has two electrodes, one electrode 20*a* which extends forwardly of the nozzle insert 26 and generates the electrostatic field in the atomization region adajcent the nozzle insert 26, and a shorter electrode 20*b*. The shorter electrode 20*b* is used to bleed off charge which may build up on the conductive nozzle insert 26 to reduce the chance of arcing upon an inadvertent approach to a grounded object with the nozzle insert 26.

The invention of this application resides the forward end portion of the gun which is generally indicated within the circled area in FIG. 1. The remainder of the gun rearwardly from this portion has not been illustrated in detail in this application because it is conventional, and has previously been described in U.S. Pat. No. 3,731,145, which is assigned to the assignee of this application. The disclosure of the foregoing patent is incorporated by reference herein for purposes of more completely describing the details of the gun 10.

With reference now to FIG. 2, the nozzle assembly is generally indicated at 25, and includes the nozzle insert 26 which is mounted within a nozzle adapter 27, a nozzle support ring 28, and a sealing plug 29. The sealing plug 29 is located between the nozzle adapter 27 and a gun body extension 30 for sealing a liquid flow passage which extends through the gun and to the nozzle insert 26. A nozzle retaining nut 31 is threaded on the gun body extension 30, and secures the nozzle support ring 28 in place on the gun body extension.

It will be noted that the elements of the nozzle assembly 25, the gun body extension 30 and the nozzle retaining nut 31 are all described in specific detail in U.S. Pat. No. 4,355,764, which is also assigned to the assignee of this application. The disclosure of that patent is incorporated by reference for additional detail on the structure and arrangement of these elements.

A central bore 32 extends axially through the extension 30 and gun body 11 into communication with the hose 14 through which liquid under high pressure is supplied to the gun. A conventional valving mechanism 24 is mounted within the central bore 32 and is operated by the trigger 13 to control the flow of liquid through the central bore 32. The other end of the central bore 32 communicates with a stepped axial bore 33 which extends through the sealing plug 29, and which is collinearly aligned with the central bore 32. The plug bore 33 is in turn collinearly aligned with a bore 34 which extends axially through the adapter 27, and within which is received the nozzle insert 26. The nozzle insert 26 has an axial passageway 35 terminating in atomizing orifice 36.

A fluid flow restrictor 37 is press-fit into the bore 33 of the sealing plug 29, and engages a shoulder 38 (FIG. 4) of the bore at its forward end. The purpose of the restrictor 37 is to break up any laminar flow of liquid to the nozzle to cause a turbulent flow, which in turn eliminates undesirable "tails" which would otherwise be on the edges of the fan-shaped pattern of liquid which emerges from the nozzle orifice 36. More specific detail concerning the restrictor and its location within the plug bore can be obtained by reference to the aforementioned U.S. Pat. No. 4,355,764.

Both the nozzle adapter ring 27, nozzle insert 26, and sealing plug 29 are mounted within a stepped axial bore 39 within the nozzle support ring 28. The adapter 27 has a flange portion 40 which extends radially outwardly from its rearward end, and which abuts a shoulder 41 formed in the support ring bore 39. This abutment is maintained by engagement of a tapered forward end section 42 of the sealing plug 29 which seats within a tapered seat 43 formed in the adapter bore 34. The sealing plug 29 has a second tapered section 45 located at its rearward end which is received in a tapered seat 46 formed in the central bore 32.

Engagement between the tapered end sections of the sealing plug and their respective tapered seats is accomplished through securing the nozzle support ring 28 and nozzle assembly 25 in place with the nozzle retaining nut 31. That is, the nozzle support ring 28 has a radially outwardly extending flange 47 which is engaged by a shoulder 48 of the nozzle retaining nut 31 such that, when the nut is threaded onto the threaded portion of the gun body extension 30, the nut engages the flange 47 of the nozzle support ring and moves the ring 28 toward the gun body extension 30. This action in turn seats the two ends of the sealing plug 29 in place, and presses the nozzle adapter 27 against the support ring 28 and the support ring against the shoulder 48 of the nut 31.

It will be noted that the length of the sealing plug is such that the plug will be tightly wedge in the tapered seat 43 of the adapter bore and the tapered seat 46 of the central bore. A gap or open space 49 is left between the rearward end of the nozzle support ring 28 and the forward end of the gun body extension 30. A pressure relief channel 50 extends from this open space to a vent to relieve any pressure buildup which might occur, as by a plugged nozzle.

The two electrodes 20*a*, 20*b*, extend through respective throughbores 52*a* and 52*b* formed in the nozzle support ring 28. As previously indicated, the longer electrode 20*a* forms the high voltage field in the vicinity of the atomization region around the nozzle orifice 36 to electrostatically charge the atomized particles for deposition on a substrate.

Figure 3A:
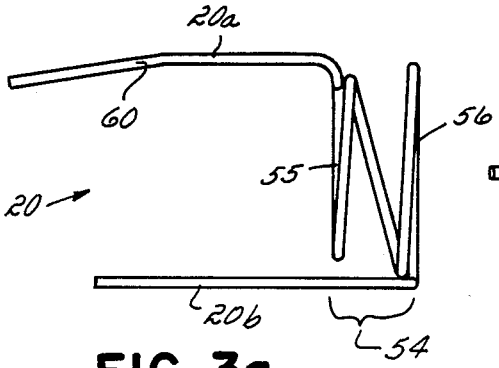
FIGS. 3*a* and 3*b* illustrate a side view and a bottom view, respectively, of the dual electrode spring.
Figure 3B:
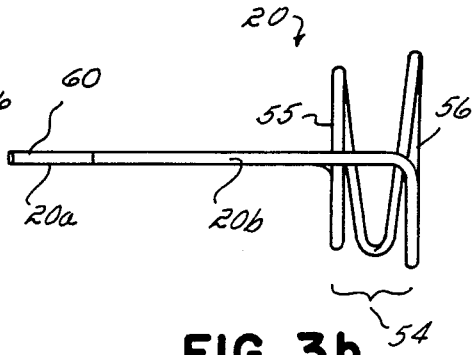

With specific reference to FIGS. 3*a* and 3*b*, the dual electrode element is formed from a single piece of wire, such as 20/1000 inch (25 guage) stainless steel wire. The ends of the wire form the electrodes 20*a*, 20*b*, which extend roughly parallel to each other. Intermediate these electrode portions is formed an electrode spring portion 54 which is a spring spiral having a first or forward loop 55 and a second or rearward loop 56. The forward loop 55 is a continuation of the longer electrode 20*a* while the rearward loop 56 turns into the shorter electrode portion 20*b*. A single piece dual electrode having a rearward spring portion 54 is thus provided.

With reference to FIG. 4, the forward loop 55 of the electrode is snap-fit around the circumference of the sealing plug 29, being received in an annular recess 57 formed slightly rearward of the center of the sealing plug. It will be noted that the sealing plug has a reduced diameter section 58 rearwardly of the annular recess 57, with the rearward tapered portion 45 next after the reduced diameter section 58. The rearward loop 56 of the electrode spring is of a slightly greater diameter than that of forward loop 55 and, moreover, is of a greater diameter than the portion of the sealing plug which it overlies. The rearward spring portion 56 is thus free to move axially, as by compression of the spring portion 54.

It will be seen that the relatively loosefitting parts of the nozzle assembly 25 will no longer drop out of the nozzle support ring 28 and become lost, due to the fact that the sealing plug 29 is now retained in its seat within the nozzle adapter ring 27 by the dual electrode element 20. That is, the electrodes 20*a* and 20*b* extending through the nozzle supporting ring hold the sealing plug 29 in place via the electrode spring portion 54. To this end, the longer electrodes 20*a* has a radially inwardly bent portion 60 which further secures the electrode element 20 in place (FIG. 2). Because the dual electrode element 20 is fairly resilient, it and the sealing plug 29 can be easily pulled out of the nozzle support ring when desired without damage to the electrodes 20*a*, 20*b*. The electrode element 20 is also easily removed from and applied to the sealing plug 29.

Referring again to FIG. 2, a second passage or bore 62 extends longitudinally through the gun body 11 and is offset from the liquid flow passage of the central bore 32. A high ohmage resistor 63, commonly referred to as a barrel resister herein, is housed within the longitudinal bore 62. This barrel resistor 63 is a 75M ohm hollow fiberglass resistor having a carbon spiral pattern formed along its outside. As previously indicated, the barrel resistor serves to reduce the current flowing through the circuitry to the electrode 20*a*, and also reduce the capacitance of the system to avoid arcing.

Another bore 65 communicates with the lower front of the barrel resistor bore 62, and angles radially downwardly therefrom to open into the open area 49. A second resistor 66, commonly referred to as a tip resistor herein, is housed within this bore 65. A typical tip resistor would be a metal oxide 12M ohm resistor, which, as previously indicated, provides additional resistance in the electrical circuit to further reduce current flow, as well as the overall system capacitance.

Electrical contact between the tip resistor 66 and the electrode 20 is accomplished through the use of a brass fitting 67 fixed to the forward end of the tip resistor 66. The fitting 67 has a broad bearing surface 70 which contacts the rearward spring loop 56 of the electrode 20. The brass fitting 67 is of course electrically conductive, and is fixed to a lead 68 extending from the forward end of the tip resistor by soldering at the bearing surface 70.

The fitting 67, and the associated tip resistor 66, are slip-fit into the tip resistor bore 65, with the bearing surface 70 extending into the open space 49 to contact and slightly compress the rearward loop 56 of the electrode spring portion 54. The broad bearing surface 70 presents a good contact surface, and continuous and direct electrical connection between the electrode element 20 and tip resistor 66 is maintained regardless of how the nozzle support ring 28, which carries electrode element 20, is attached to the gun. That is, the electrical contact between the rearward spring loop 56 and the conductive bearing surface 70 is maintained regardless of the rotational position of the nozzle assembly 25 on the gun body extension 30.

It will be noted that the use of a spring portion 54 as part of the electrode element has the additional advantage of accommodating any variations in distance between the sealing plug 29 and tip resistor 66 which might occur through tolerance variations in the nozzle parts. An annular recess 71 is also provided surrounding the forward opening of the tip resistor bore 65 to permit ready access to the fitting 67 with a pry tool for removal of the fitting and tip resistor from the bore.

The electrical connection between the tip resistor 66 and the barrel resistor 63 is made with a spring lead 72 which extends from the rearward end of the tip resistor and which contacts a conductive end cap 73 surrounding the forward end of the barrel resistor 63. The spring load 72 is secured at one end by soldering to the rearward end of the tip resistor 66, and is left free to abut against an angled shoulder 74 formed around the conductive cap 73.

The conductive cap 73 is made of a conductive Teflon, such as Teflon containing 15–25% graphite or carbon. The cap 73 is mounted in the forward end of the bore 62, with the barrel resistor forward end abutting the front 75 of the cap. An insulative tube 76, such as are made of polyethylene, is located within the bore 62 rearwardly of the cap 73.

Use of the conductive cap 73 herein permits the electrical connection with the barrel resistor 63 to be made at a point rearwardly of the forward end of the barrel resistor. That is, the lead 72 from the tip resistor no longer has to be connected at the very front of the barrel resistor, but can now be easily connected at a more rearward point on the barrel resistor, thus simplifying replacement of the tip resistor. Use of a spring lead 72 also assures that the gap between the tip resistor 66 and the cap 73 will be spanned and a good electrical contact will be made, thus further simplifying the replacement of the tip resistor.

Both the tip resistor fitting 67 and the conductive cap 73 of the barrel resistor 63 are provided with O-ring seals to seal the respective bores against solvent leaking therein which could degrade the resistors, particularly the barrel resistor 63. Fitting 67 is provided with an O-ring seal 78 which is received in a circumferential recess 79. The conductive cap 73 is likewise provided with an O-ring seal 80 received in a circumferential recess 81 formed in the cap. The two bores 65 and 62 are thus sealed against solvent leaking into the bores and damaging the two resistors.

Figure 5:
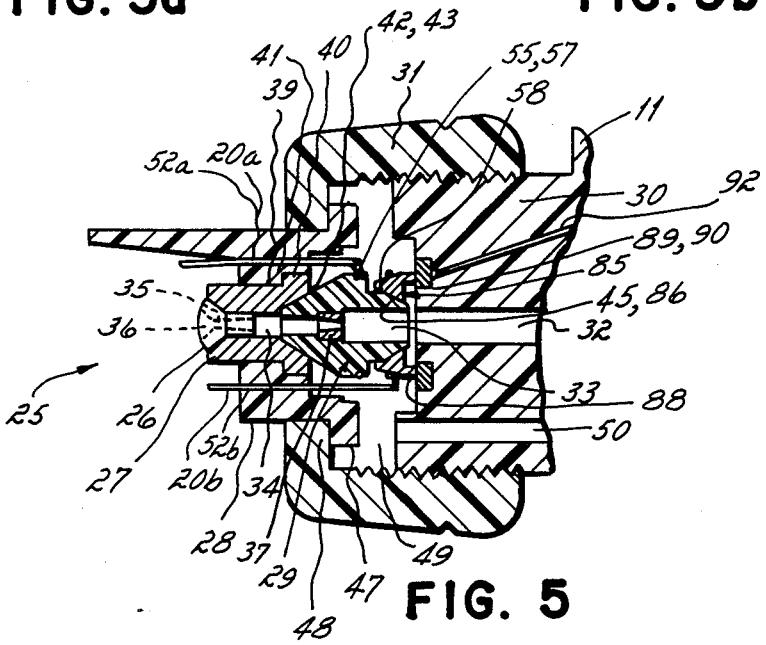
FIG. 5 is a view similar to that of FIG. 2, but illustrating a modified form of the invention.
Figure 6:
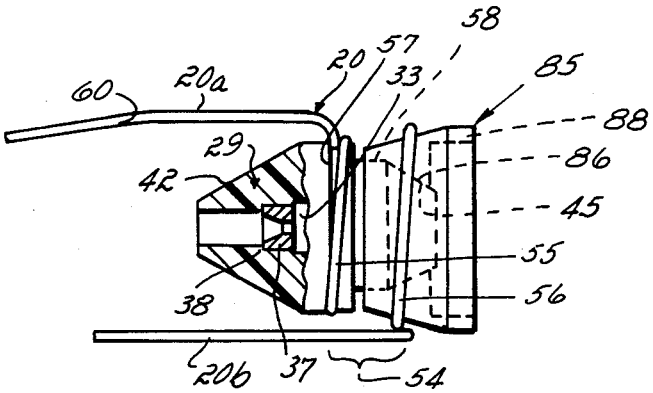
FIG. 6 is an enlarged view of the dual electrode spring, sealing plug and adapter as assembled in the modified embodiment of FIG. 5.

Reference is now made to FIGS. 5 and 6 which show a modified version of the invention. The spray gun assembly illustrated in these figures is substantially similar to that previously described, except that the sealing plug 29 does not have its rearward portion 45 seated in a tapered seat formed in the central bore 32. Instead, the rearward tapered portion 45 of the sealing plug seats within a ringshaped adapter 85 which is provided with an internally tapered seat portion 86. The adapter 85 is made of stainless steel, and is engaged in an interference fit on the reduced diameter portion 58 of the sealing plug 29 (FIG. 6). The rearward loop 56 of the electrode spring portion 54 engages the exterior of the adapter 85. The adapter is provided with a slight exterior taper which is at an angle to lightly compress the spring portion 54 of the electrode assembly to make good electrical contact between the conductive stainless steel adapter 85 and the rearward loop 56.

Referring again to FIG. 5, the adapter 85 has an annular shaped skirt portion 88 which engages the surface of a conductive washer 89 which is mounted in a recess 90 formed in the front end of the gun body extension 30 concentric with the axial bore 32. Continuous electrical contact between the flat edge of the adapter skirt edge and the conductive washer 89 is maintained by this arrangement, since the skirt 88 will always be engaged with the washer surface, regardless of the rotational position of the nozzle assembly. The conductive washer 89 is in turn electrically connected to a barrel resistor (not shown in this embodiment) through the use of a lead in the form of a conductive pin 92 mounted in the gun body extension 30. No tip resistor is used in this embodiment, which illustrates an earlier version of the gun previously described. It will also be noted that the surface contact between the adapter skirt 88 and the conductive washer 89 serves to seal this area against the leakage of fluid or solvent from the axial bore 32.

As in the previous embodiment, this embodiment has the advantage of keeping all of the pieces of the nozzle assembly 25 together when the nozzle assembly is removed by virtue of the electrode element 20 which holds the sealing plug 33 in place against the nozzle adapter ring 27. The adapter 85 is of course tightly fit to the sealing plug, and will therefore not fall off.

Thus, while the invention has been described in connection with certain presently preferred embodiments, those skilled in the art will recognize modifications of structure, arrangement, portions, elements, materials, and components which can be used in the practice of the invention without departing from the principals of this invention.

What is claimed is:

1. An airless spray gun for electrostatically coating a substrate with an atomized liquid, comprising:

a spray gun body having a passage therethrough adapted to convey a liquid coating material which is under pressure;

a spray nozzle through which coating material can issue in an airless atomized spray;

spray nozzle mounting means for removeably mounting said spray nozzle on said spray gun body and in fluid communication with said liquid passage for flow of coating material from said liquid passage to said nozzle;

an electrode, said electrode carried by said spray nozzle mounting means and having a forward portion extending from said spray nozzle mounting means and adjacent said nozzle for generating an electrostatic field to charge the atomized coating material, and a rearward portion formed into a spiral spring;

electrical circuit means for carrying a high voltage to said electrode, said electrical circuit means including an electrode contact member engaging said spring portion of said electrode for electrical connection of said electrode to said electrical circuit means;

said spray nozzle mounting means including a nozzle mount for said nozzle having a bore through which the coating material passes to said nozzle, and sealing means for connecting said nozzle mount bore with said liquid passage, said sealing means having an axial channel for flow of coating material from said liquid passage to said nozzle mount bore, said electrode spring portion engaging said sealing means and holding said sealing means and said nozzle mount together when said spray nozzle mounting means is removed from said spray gun body.

2. The spray gun of claim 1 wherein said electrode contact member comprises a resistor having a front end and a rear end, and an electrically conductive bearing surface formed on the front of said resistor, said bearing surface abutting said electrode spring portion to make electrical contact therewith.

3. An airless spray gun for electrostatically coating a substrate with an atomized liquid, comprising:

a spray gun body having a forward end and a passage therethrough adapted to convey a liquid coating material which is under pressure to said forward end;

a spray nozzle assembly adapted to be secured to said forward end of said gun body, said nozzle assembly including, a spray nozzle communicating with said coating material passage through which the coating material issues in an airless atomized spray, a nozzle mount for said spray nozzle having a bore through which the coating material passes to said nozzle, sealing means for connecting said nozzle mount bore with said liquid passage, said sealing means having an axial channel for flow of coating material from said liquid passage to said nozzle mount bore;

an electrode for electrostatically charging atomized coating material;

an electrode mount for said electrode which is concentric with said nozzle mount;

said electrode having a forward portion extending through said electrode mount and adjacent said nozzle for generating an electrostatic field to charge the atomized coating material, and an integral rearward portion formed into a spiral spring;

an electrical circuit means for carrying a high voltage to said electrode, said electrical circuit means including an electrode contact abutting said spring portion of said electrode, said electrode contact and said spring portion being in continuous electrical contact regardless of how said electrode mount is rotated; and said electrode spring portion engaging said sealing means and holding said sealing means and said nozzle mount together when said spray nozzle assembly is not secured to said gun body forward end.

4. The spray gun of claim 3 wherein said electrode mount is a nozzle support ring forming part of said nozzle assembly, said support ring having an axial passage therethrough, said nozzle mount being mounted within said support ring axial passage, said forward portion of said electrode extending through a throughbore formed in said support ring, and said electrode rearward spring portion engaging said sealing means to hold said sealing means within said nozzle mount bore and said nozzle mount to said support ring when said spray nozzle assembly is not secured to said gun body forward end.

5. The spray gun of claim 3 wherein said sealing means is a plug having a forward end received in a seat formed in said nozzle mount, and a rearward end received in a seat formed in said gun body around said coating material passage, said plug rearward end being further received within said electrode spring portion and thereby held within its nozzle mount seat by said electrode when said spray nozzle assembly is removed from said gun body.

6. The spray gun of claim 5 wherein said electrode spring portion has a forward loop and a rearward loop, said forward loop being received in a recess formed on said plug, said rearward loop being radially spaced from said plug and free to be axially moved by a compressive force applied from engagement with said electrode contact.

7. The spray gun of claim 6 wherein said electrical circuit means includes a tip resistor having a forward lead and a conductive fitting surrounding said lead, said fitting having a broad surface forming said electrode contact engaging said rearward electrode spring loop.

8. The spray gun of claim 3 wherein said electrical circuit means includes a first resistor having a front end and a rear end, a conductive fitting fixed to said front end of said first resistor and presenting a broad conductive surface forming said electrode contact engaging said electrode spring portion, a spring lead fixed at one end to said rear end of said first resistor, a second resistor having a front end and a rear end, an electrically conductive cap surrounding said front end of said second resistor, a portion of said cap extending rearwardly along said second resistor, said spring lead of said first resistor contacting said rearwardly extending portion of said conductive cap to electrically connect said first and second resistors.

9. The spray gun assembly of claim 3 wherein said sealing means is a plug member having a forward end sealingly received in a seat formed in said nozzle mount, and a rearward end, said electrode spiral spring portion being engaged with said plug member and holding said plug member within its seat in said nozzle mount.

10. The spray gun assembly of claim 9 wherein said electrode spring portion has a forward loop and a rearward loop which are coaxial, said forward loop being engaged with said plug member and coaxial therewith, said rearward loop being radially spaced from said plug member and free for limited axial movement.

11. The spray gun assembly of claim 10 wherein said electrode contact comprises a conductive ring having a front portion and a rear portion, said front portion adapted to be received on said rearward end of said plug member and to sealingly seat said plug member therein, said rearward electrode spring loop engaging said conductive ring in an electrical connection, said rear portion of said ring terminating in a flat ring edge, said electrical circuit means further including an electrically conductive washer mounted on said elongated body and concentric with said liquid passage, said ring edge engaging said conductive washer and in contact therewith around said entire ring edge.

12. An airless spray gun comprising:

an elongated body having a passage therethrough adapted to be connected with a supply of liquid coating material under sufficient pressure to effect airless atomization of said liquid coating;

a nozzle assembly adapted to be secured to said elongated body, said nozzle assembly including, an airless spray nozzle having a liquid passage therethrough, a nozzle adapter having an axial passage therethrough, said axial passage being coaxially aligned with said liquid passage, said nozzle being mounted in said nozzle adapter axial passage, a nozzle mounting ring having an axial passage therethrough, said axial passage being coaxially aligned with said liquid passage, said nozzle adapter being mounted within said nozzle mounting ring axial passage, sealing means between said adapter and said elongated body, said sealing means having an axial channel through which liquid can pass from said liquid passage through said sealing means to said nozzle adapter and nozzle passages;

a single piece electrode carried by said nozzle mounting ring, said electrode having two forward portions extending through throughbores in said nozzle mounting ring and adjacent said nozzle for imparting a charge to fluid atomized by said nozzle, and a rearward portion formed in a spring spiral, and electrical circuit means for connecting said electrode to a voltage source, said electrical circuit means including resistor means and an electrode contact abutting said electrode spring spiral portion to electrically connect said electrical circuit means with said electrode.

13. The spray gun of claim 12 wherein said sealing means is a connecting plug having a conical rearward portion on which is received said electrode spring spiral portion, said electrode holding said plug in place with said nozzle adapter upon removal of said nozzle assembly from said elongated body.

14. The spray gun of claim 12 wherein said resistor means includes a barrel resistor and a tip resistor, said barrel and tip resistors being electrically connected by a lead, said tip resistor having a forward bearing surface forming said electrode contact abutting said electrode spring spiral portion.

15. The spray gun of claim 14 wherein said lead connecting said barrel and tip resistors is a spring fixed at one end to rearward end of said tip resistor, and further including a conductive cap member mounted on said barrel resistor which is engaged by the other end of said spring lead at a point rearward of a forward end of said barrel resistor.

16. The spray gun of claim 13 wherein said electrode spring spiral portion has a forward loop and a rearward loop, said loops being coaxial with said connecting plug, said forward loop being engaged with said plug, said rearward loop being radially spaced from said plug and free for limited movement, and wherein said electrode contact comprises a conductive ring having a front portion and a rear portion, said ring front portion adapted to be received on said rearward portion of said plug and to sealingly seat said plug therein, said rearward electrode spring loop engaging said ring in an electrical connection, said rear portion of said ring having a flat ring edge, said electrical circuit means further including an electrically conductive washer mounted on said elongated body and concentric with said liquid passage, said ring edge engaging said conductive washer and in contact therewith around said entire edge, said ring edge thereby forming a seal between said washer and ring.

17. The spray gun of claim 14 wherein said barrel resistor is housed in a bore extending generally parallel to said liquid passage, and said tip resistor is housed in a bore angled radially inwardly towards said first passage and intersecting said parallel bore at a point rearwardly of the front of said parallel bore, and further including a conductive cap surrounding the forward portion of said barrel resistor and extending rearwardly at least to said angled bore, said lead connecting said tip and barrel resistors being a spring fixed at one end to said tip resistor and in electrical contact with said conductive cap at its other end at a point spaced rearwardly from the front of said barrel resistor.

18. The spray gun of claim 17 wherein said tip resistor has a conductive fitting fixed to the forward end of said tip resistor presenting said forward bearing surface engaging said electrode spiral, said fitting further including an O-ring seal for sealing said fitting in said angled bore, said barrel resistor cap further including an O-ring seal for sealing said cap in said parallel bore.

19. An airless spray gun comprising:

an elongated body having a passage therethrough adapted to be connected with a supply of liquid coating material under sufficient pressure to effect airless atomization of said liquid coating;

a nozzle assembly adapted to be secured to said elongated body, said nozzle assembly including, an airless spray nozzle having a liquid passage therethrough, a nozzle adapter having an axial passage therethrough, said axial passage being coaxially aligned with said liquid passage, said nozzle being mounted in said nozzle adapter axial passage, a nozzle mounting ring having an axial passage therethrough, said axial passage being coaxially aligned with said liquid passage, said nozzle adapter being mounted within said nozzle mounting ring axial passage, sealing means between said adapter and said elongated body, said sealing means having an axial channel through which liquid can pass from said liquid passage through said sealing means to said nozzle adapter and nozzle passages;

a single piece electrode carried by said nozzle mounting ring, said electrode having at least one forward portion extending through a throughbore in said nozzle mounting ring and adjacent said nozzle for imparting a charge to fluid atomized by said nozzle, and a rearward portion formed in a spring spiral, and electrical circuit means for connecting said electrode to a voltage source, said electrical circuit means including resistor means and an electrode contact abutting said electrode spring spiral portion to electrically connect said electrical circuit means with said electrode.

* * * * *